United States Patent [19]

O'Dell

[11] Patent Number: 4,802,251

[45] Date of Patent: Feb. 7, 1989

[54] TOP AND BOTTOM BED-SHEETING COMBINATION

[76] Inventor: Mark A. O'Dell, 731 S. Whiting Cir., Mesa, Ariz. 85204

[21] Appl. No.: 134,258

[22] Filed: Dec. 17, 1987

[51] Int. Cl.[4] ..... A47C 23/00

[52] U.S. Cl. ..... 5/502

[58] Field of Search ..... 5/502, 485, 492

[56] References Cited

U.S. PATENT DOCUMENTS

| | | | |
|---|---|---|---|
| 1,859,820 | 5/1932 | Eaker | 5/502 |
| 2,662,234 | 12/1953 | Citron | 5/495 |
| 3,331,088 | 7/1967 | Marquette | 5/502 |
| 3,857,124 | 12/1974 | Hadley | 5/502 |
| 4,316,299 | 2/1982 | Friedman | 5/502 |
| 4,384,380 | 5/1983 | Glaha | 5/502 |
| 4,413,368 | 11/1983 | Schuetze | 5/502 |

*Primary Examiner*—Reinaldo P. Machado

*Attorney, Agent, or Firm*—James F. Duffy

[57] ABSTRACT

The coupled combination of a bottom bed sheet and a top bed sheet, the coupling along one or more edges tending to maintain reasonable order and neatness of the bed linens at the side(s) and/or foot of the bed adjacent the sites at which the sheets are coupled. An embodiment for a double bed provides for central entry of a person between the coupled sheets.

6 Claims, 1 Drawing Sheet

TOP AND BOTTOM BED-SHEETING COMBINATION

BACKGROUND OF THE INVENTION

1. Field of the Invention

The invention relates to the field of bedding. In particular, the invention relates to sheets used in making up a bed. More specifically, the invention relates to the coupled combination of a fitted bottom sheet and a top sheet, which coupled combination eases the task of making up a bed.

2. Prior Art

"Making the bed" is a task which repels most homemakers and at which most teenagers rebel. A bed, in general, comprises a mattress and its support, most frequently a box spring. In making up the bed, a sheet is placed atop the mattress. The sheet is large enough to cover the top surface of the mattress and to extend below the perimeter sides of the mattress. The extended portions are tucked in, under the mattress, to maintain the sheet in position while a person is sleeping on the sheet. This sheet, first applied when making a bed, is denoted the "bottom sheet", since a second, or "top sheet", will be applied as well.

Bottom sheets are often tailored to fit a mattress. Such "fitted sheets" have their four perimeter sides, and the extensions thereof, contoured and elasticized to fit snuggly about the mattress and maintain the sheet in place.

A top sheet is placed on the bottom sheet and the left and right perimeter sides, as well as the foot perimeter side of the sheet are drawn down about the mattress and the excess sheet is tucked in, under the mattress. The head perimeter side of the top sheet is not drawn down and tucked in. Instead, the top sheet is only brought to the head edge of the mattress so that a person seeking rest may settle down between the top and bottom sheets.

It is the person between the sheets who musses the bed. The top sheet is pulled back, its edges no longer in neat repose beneath the mattress. The problem is compounded throughout the night as the person tosses and turns between the sheets in sleep.

The fitted sheet has been a boon to bed makers. A few pats and a swipe of the hands frequently suffices to return the bottom sheet to a reasonable semblance of neatness. It is the top sheet that most frustrates the bed maker. There is much lifting and smoothing of the sheet and numerous trips around the bed before neatness is restored, with the top smooth and the edges tucked in beneath the mattress.

The bed maker faces other problems, especially when a side or an end, or both, of the mattress is virtually inaccessible as when a side or end is adjacent a wall. This frequently occurs in smaller bed rooms and in children's rooms where there are bunk beds, or built-in beds. The bed maker must climb across the bed to tuck in the sheet edges at the otherwise inaccessible side of the bed.

While it is possible to reach all or most of the way across a twin size bed, it is generally impossible to do so with a double bed or one of larger size. The bed maker must move back and forth around the bed in order to make it up.

The invention seeks to ease the task of bed making by eliminating or reducing the number of times a sheet must have its edges tucked and re-tucked in beneath the mattress. Further, the invention seeks to reduce the movement of the bed maker about the double size, or larger, bed by enabling the bulk of the bed maker's activity to take place at one side of the bed.

Prior art of interest was found in the French Brevet D'Invention No. 1.287.099 and the Offenlegungsschrift issued in West Germany as OLS 2.150.290. Both disclose blankets for use on double beds. The blanket has two overlapping sections. The overlap occurs in the central region of the bed and enables one of two occupants of the bed to effectively discard the covering without disturbing the other occupant. These blankets do not ease the task of making a bed and they are not disclosed as being in combination with any other item of bedding. No teaching is presented which would lead one to experiment with coupled combinations of these blankets and other bedding items. Since they neither anticipate nor make obvious the present invention, they are noted here as of interest only.

SUMMARY OF THE INVENTION

The invention may be summarized as bed sheeting for use with a bed having a mattress on which a bottom sheet may be fittingly emplaced. The sheeting comprises a bottom sheet to removably encompass a mattress and having four perimeter sides including a head side and a foot side, a left and a right side. There is a top sheet having an edge coupled to at least one of the four perimeter sides of the bottom sheet. This arrangement makes easier the task of making up a bed on which the sheeting is utilized.

Several embodiments are disclosed wherein:

a. the top sheet has an edge coupled to at least one of the left side and the right side of the bottom sheet;

b. the top sheet has a first free length extendible at least to the head side of the bottom sheet and a second length extending beyond the foot side of the bottom sheet;

c. the top sheet has an edge coupled to the foot side of the bottom sheet;

d. the top sheet comprises two sheeting sections coupled to the bottom sheet along the bottom side thereof such that a first one of the two sheeting sections covers more than a first half of the top surface of the bottom sheet, a second one of the two sheeting sections covers more than a second half of the top surface of the bottom sheet, and each of the first and the second ones of the two sheeting sections overlap in a region central to the top surface of the bottom sheet; and, e. the first one of the two sheeting sections is further coupled to the bottom sheet along the left side thereof and the second one of the two sheeting sections is further coupled to the bottom sheet along the left side thereof.

The method of the invention is that of assembling bed sheeting to ease the task of making up a bed. The method comprises the steps of:

a. providing a bottom mattress-sheet having four sides to encompass the sides of a mattress about the perimeter thereof and to extend beneath a mattress, the four sides and the extensions thereof being here denoted as the perimeter sides of the bottom sheet, the perimeter sides being here further denoted as head side and foot side, left side and right side;

b. providing a top sheet as a covering for the bottom sheet when the bottom sheet is emplaced on the mattress of a bed; and, c. coupling an edge of the top sheet to at least one of the four perimeter sides of the bottom sheet.

Certain limitations on the methodology is disclosed with respect to certain steps of the method as where:

d. the coupling step (step c) comprises the step of coupling the top sheet to the foot side of the bottom sheet;

e. the coupling step (step c) comprises the step of coupling the top sheet to the foot side and to at least one of the left side and the right side of the bottom sheet;

f. the coupling step (step c) comprises the step of coupling the top sheet to at least one of the left side and the right side of the bottom sheet;

f. the step of providing a top sheet (step b) further comprises the step of arranging two sections of sheeting as a covering for the bottom sheet when the bottom sheet is emplaced on a mattress, the arrangement providing an overlap of each of the two sections of sheeting along the central region of the bottom sheet;

g. the coupling step (step c) comprises the step of coupling the two sections of sheeting to the foot end of the bottom sheet;

h. the coupling step (step g) further comprises the steps of;

i. coupling a first of the two sections of sheeting to the left side of the bottom sheet; and j. coupling a second of the two sections of sheeting to the right side of the bottom sheet.

The products produced by practice of the methodology disclosed herein are claimed.

DETAILED DESCRIPTION OF THE INVENTION

Figure 1:
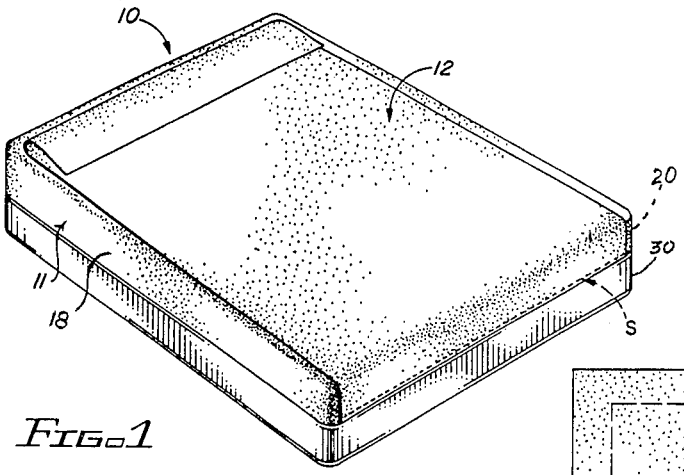
FIG. 1 is a perspective view of a bed on which the sheeting used comprises, in combination, a bottom sheet and a top sheet, the top sheet being coupled to the bottom sheet at the foot end thereof.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention partains.

The invention 10 comprises the coupled combination of a bottom bed sheet 11 and a top sheet 12. For purposes of this disclosure, the coupled combination of a bottom bed sheet and a top sheet may be considered as either the coupled combination of a fitted sheet and a flat sheet, or the coupled combination of two flat sheets.

In the illustration of FIG. 1, bottom sheet 11 has been applied to mattress 20, hidden in the illustration because covered by bottom sheet 11. When sheet 11 is placed on a mattress 20, portions of the sheet extend down about the four sides of mattress 20. It is thus possible to define sheet 11 as having four sides 18 which encompass the sides of mattress 20 about the perimeter thereof and extend beneath the mattress. These four sides 18 of bottom sheet 11, and the portions thereof which extend beneath the mattress 20, are herein denoted as "perimeter sides" of sheet 11.

In practice, top sheet 12 will extend down over the left and right perimeter sides of mattress 20. The width of sheet 12 has been narrowed for clarity of illustration in FIG. 1.

Mattress 20 is shown supported by a box spring 30, as is typical.

The perimeter sides 18 of bottom sheet 11 are denoted conventionally as head and foot sides, and left and right sides. The right and left sides are defined with respect to a person standing at the foot of the bed and facing the head of the bed.

In FIG. 1, the dotted line referenced S indicates that top sheet 11 is coupled to bottom sheet 12 at the foot end of sheet 12. It is preferrable that the exact site at which the two sheets are coupled shall be such as to permit a person sleeping between sheets 11 and 12 to lie comfortably with feet extended beyond the foot end of mattress 20, toes downward. Similar considerations hold when the coupling is effected along a side of sheet 12.

The method by which sheet 11 is coupled to sheet 12 may be such as to provide a permanent or a non-permanent coupling. Thus, the sheets might be permanently coupled by sewing them together along a selected edge, or edges, of sheet 12. Alternatively, the sheets might be readily decoupled by use of hook and loop fasteners, or the like, as the coupling means.

Figure 2:
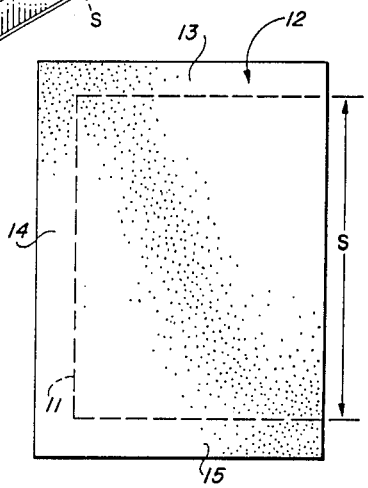
FIG. 2 is a plane view of a combination bottom and top sheet combination indication the sheets as coupled along side S of the bottom sheet.

With the arrangement of FIG. 1, the bed maker begins the task of making up the bed having found the bed with the sheets already in order at the foot end of the bed. The disclosure here is not intended to limit the coupling of sheets 11 and 12 to the foot side of sheet 11. In FIG. 2, the situs of coupling of the two sheets has been moved to the right side of the illustration.

In FIG. 2, sheet 11 is shown in phantom outline. Top sheet 12 is seen to have free lengths 13, 14, and 15. These free lengths extend beyond the head, left, and foot side of bottom sheet 11 in the illustration. A bed utilizing the coupled combination of sheets shown in FIG. 2 may be placed fully against one of the walls of a room without imparing the bed maker's ability to make up the bed.

Many homes have small rooms in which a bed is emplaced flush against a wall. Preparing such a bed with clean linen is a formidable task. Making up the bed each day challenges the stout of heart. Use of the coupled combination of sheets of Fig. 2 reduces that daily challenge. Once the bed is freshly made up with the coupled sides of the sheets adjacent the wall, the coupling of the sheets will tend to maintain the sheeting, on the side of the bed adjacent the wall, in good order; and the bed is easily made up.

Figure 3:
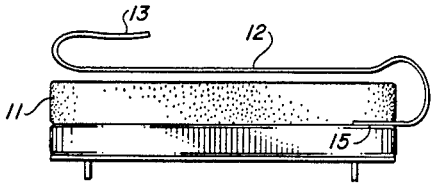
FIGS. 3 & 4 are elevation views of a bed with the sheeting of FIG. 2 thereon, illustrating that either end of the bed may be made up as the head end of the bed.
Figure 4:
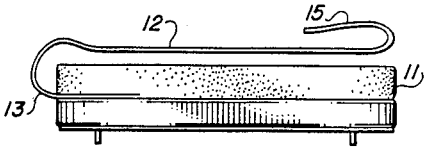

In FIGS. 3 and 4 are shown a bed made up with the coupled combination of sheets 11 and 12 of FIG. 2, the situs S of the coupling of the sheets being oriented into the paper. As illustrated by FIGS. 3 and 4, either end of the bed can serve as the head end depending on which length of sheet 12 is tucked in, length 13 or length 15.

Consider now the coupled combination of sheets 11 and 12 wherein the coupling site S includes both the foot side of sheet 11 (as shown in FIG. 1) as well as the right side (shown in FIG. 2). Such a combination will allow one side of the bed as well as the foot of the bed to remain in relatively good order for making up each day. For greatest versatility, this side-and-foot coupled combination should be achieved with two flat, un-fitted sheets since it can then be utilized regardless of the orientation of the bed within the room. Employing a fitted sheet will limit the utility of the coupled combination to specifically oriented beds.

Figure 5:
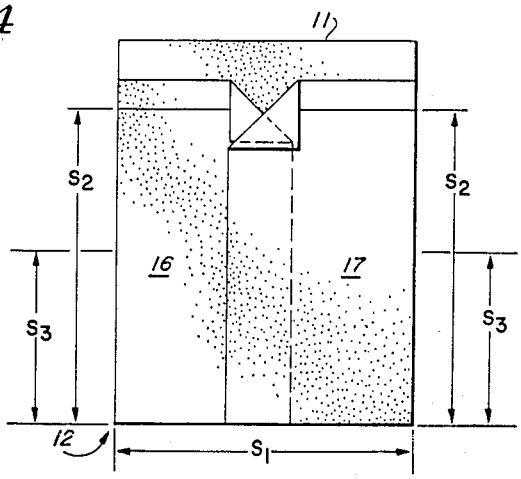
FIG. 5 illustrates another embodiment of the bottom and top sheet combination in use on a double size bed, the top sheet comprising two overlapping sections.

Making up a bed large enough to be occupied comfortably by two persons is somewhat difficult because the size of the bed precludes reaching across the mattress to make up the far side. Because of this, the bed maker must usually make one or more trips about the bed before it is made up, neat and in order. FIG. 5 illustrates an embodiment of the invention ideally suited to the larger sized bed.

In FIG. 5, top sheet 12 is comprised of two sheeting sections 16 and 17. Sections 16 and 17 of sheet 12 are coupled to bottom sheet 11 at coupling sites S1, and S2 at the foot end and the left and right sides of sheet 11. As seen in the drawing, sheet sections 16 and 17 overlap in the central region of the bed. In the illustrated embodiment, a person enters between sheets 11 and 12 from the center of the bed.

The bed maker will find the bed sheeting in fairly good order to be made up each day. Sheet section 16 can be smoothed by hand without leaving the left side of the bed. From the same left side, sheet section 17 can be readily manipulated to lay smoothly atop the bed. The task of making up a double, or larger, size bed is greatly eased when the embodiment configured as shown in FIG. 5 is utilized.

Some persons may object to having to enter the bed from the center rather than the side of the bed. To meet their need, an embodiment of the invention is disclosed in which sheets 11 and 12 are coupled at left and right sides at coupling sites S3 only, so as to allow a portion of sheet sections 16 and 17 to be drawn downwardly on the bed to allow entry from the side of the bed.

What has been disclosed is the coupled combination of a bottom bed sheet and a top bed sheet, the coupling along one or more edges tending to maintain reasonable order and neatness of the bed linens at the sides and/or foot of the bed adjacent the sites at which the sheets are coupled. An embodiment for a double bed provides for central entry of a person between the coupled sheets.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. Bed sheeting for use with a bed having a mattress on which a bottom sheet may be fittingly emplaced, said sheeting comprising:

a bottom sheet to removably encompass a mattress and having four perimeter sides including a head side and a foot side, a left and a right side; and, a top sheet comprising two sheeting sections coupled to said bottom sheet along the bottom side thereof such that a first one of said two sheeting sections covers more than a first half of the top surface of said bottom sheet, a second one of said two sheeting sections covers more than a second half of the top surface of said bottom sheet, and each of said first and said second ones of said two sheeting sections overlap in a region central to the top surface of said bottom sheet.

2. The sheeting of claim 1 wherein said first one of said two sheeting sections is further coupled to said bottom sheet along said left side thereof and said second one of said two sheeting sections is further coupled to said bottom sheet along said left side thereof.

3. The method of assembling bed sheeting to ease the task of making up a bed comprising the steps of:

a. providing a bottom mattress-sheet having four sides to encompass the sides of a mattress about the perimeter thereof and to extend beneath a mattress, said four sides and the extensions thereof being here denoted as the perimeter sides of said bottom sheet, said perimeter sides being here further denoted as head side and foot side, left side and right side;

b. arranging two sections of sheeting as a covering for said bottom sheet when said bottom sheet is emplaced on a mattress, the arrangement providing an overlap of each of said two sections of sheeting along the central region of said bottom sheet; and c. coupling said two sections of sheeting to the foot end of said bottom sheet.

4. The method of claim 3 wherein the coupling step (step c) further comprises the steps of:

d. coupling a first of said two sections of sheeting to said left side of said bottom sheet; and e. coupling a second of said two sections of sheeting to said right side of said bottom sheet.

5. The product produced by the practice of the method of claim 3.

6. The product produced by the practice of the method of claim 4.

* * * * *